US006807761B2

(12) United States Patent
Rappaport et al.

(10) Patent No.: US 6,807,761 B2
(45) Date of Patent: Oct. 26, 2004

(54) PERSONALIZED PICTURE POSTCARD FOR HOLDING INSERTED PHOTOGRAPH

(75) Inventors: Naomi R. Rappaport, Golden Valley, MN (US); Jon D. Rappaport, Golden Valley, MN (US)

(73) Assignee: Sunshine Girl Creations Inc., Hopkins, MN (US)

( * ) Notice: Subject to any disclaimer, the term of this patent is extended or adjusted under 35 U.S.C. 154(b) by 0 days.

(21) Appl. No.: 10/356,803

(22) Filed: Feb. 3, 2003

(65) Prior Publication Data

US 2003/0121194 A1 Jul. 3, 2003

Related U.S. Application Data

(63) Continuation-in-part of application No. 09/792,329, filed on Feb. 23, 2001, now Pat. No. 6,701,654.

(51) Int. Cl.[7] ..... G09F 1/02; B42D 15/04

(52) U.S. Cl. ..... 40/776; 40/654.01; 229/92.8; 229/71

(58) Field of Search ..... 40/776, 775, 771, 40/661, 654.01; 229/92.8, 71

(56) References Cited

U.S. PATENT DOCUMENTS

| | | | | |
|---|---|---|---|---|
| 3,762,630 A | * | 10/1973 | Braznell | 229/92.8 |
| 3,899,127 A | * | 8/1975 | Melander | 229/303 |
| 4,231,833 A | | 11/1980 | Lieberman | |
| 4,741,119 A | * | 5/1988 | Baryla | 40/594 |
| 4,914,842 A | | 4/1990 | Lieberman | |
| 5,788,144 A | * | 8/1998 | Sorge et al. | 229/92.8 |
| 5,983,537 A | * | 11/1999 | Johnson | 40/124.04 |
| 6,024,277 A | * | 2/2000 | Martin | 229/71 |
| 6,578,304 B1 | * | 6/2003 | Lytle | 40/711 |

FOREIGN PATENT DOCUMENTS

| | | | | |
|---|---|---|---|---|
| EP | 0924139 A1 | * | 6/1999 | B65D/27/04 |
| WO | WO 9220528 A1 | * | 11/1992 | B42D/15/04 |

OTHER PUBLICATIONS

Fotocard Inernational Ltd. Postcard Product Was Being Sold Prior to 1999 in New Zealand Namely Auckland New Zealand.

* cited by examiner

*Primary Examiner*—Cassandra Davis
(74) *Attorney, Agent, or Firm*—James V. Harmon

(57) ABSTRACT

A personalized picture postcard for holding inserted photographs has a trilaminate structure that includes a backing sheet of a rectangular shape that has an exposed lower surface provided with printed indicia indicating the location of a mailing address and a position for writing a message to the recipient, a rectangular transparent window sheet adhesively bonded to an upper surface of the backing sheet along three aligned side edges to define an envelope therebetween that is open on one end and a magnetic strip sandwiched therebetween and bonded to the backing sheet. The backing sheet has a strip of pressure-sensitive adhesive extending along the remaining edge i.e., the free edge thereof. A removable cover strip or liner is releasably secured over the pressure-sensitive adhesive strip to define an open end into which a photo can be inserted by the user. A rectangular border is provided for framing the inserted photo. The border is aligned with the side and end edges of the postcard over the adhesive so as to obscure the adhesive for providing an attractive appearance and after passing through the mail the magnetic strip can be used to secure the postcard and photo to a vertical metallic surface.

12 Claims, 5 Drawing Sheets

PERSONALIZED PICTURE POSTCARD FOR HOLDING INSERTED PHOTOGRAPH

This is a Continuation-in-Part of application Ser. No. 09/792,329 filed Feb. 23, 2001 now U.S. Pat. No. 6,701,654.

FIELD OF THE INVENTION

This invention relates to postcards and more particularly to a postcard that is personalized with a picture supplied by the user.

BACKGROUND OF THE INVENTION

Various envelopes such as window envelopes have been previously proposed for various applications. These envelopes are provided with glued edges, but there is no provision for enabling the end user to seal the envelope without taking additional steps such as licking the flap to moisten the adhesive on the flap. In order to be commercially acceptable for use with a personal photograph it is necessary to find a way of hiding the glue located at the edges of the postcard while simultaneously embellishing the product to enhance its visual appeal. If the postcard is to have the proper feel and stiffness it is desirable to provide a backing sheet having a degree of stiffness and yet find a way of enabling a photo to be mounted in place and the postcard to be easily sealed in spite of stiffness of the backing used in the construction of the postcard. More specifically, during the development of the present invention it was found desirable to find a way of providing access to a self-sealing strip so that it could be easily uncovered for enabling an inserted picture to be totally enclosed by bonding the self-sealing strip to an adjacent surface of the postcard.

One prior postcard product described in U.S. Pat. Nos. 4,231,833 and 4,914,842 had an adhesive applied to the entire surface of a transparent backing sheet with a protective sheet positioned over it. The entire width and breadth of the postcard was covered with pressure-sensitive adhesive. In addition to the expense of the adhesive, the assembly was complicated. It was necessary to peel a clear backing from a border element, press the product firmly over a photograph, cut around the edges with scissors, next peel the postcard from the adhesive backing and finally place it on the back of the product.

In view of these and other deficiencies of the prior art, it is one object of present invention to provide an improved personalized postcard for holding an inserted photograph that is relatively low in cost, durable in construction and easier to use than prior products.

Another object is to provide a personalized postcard of the type described that can be formed from sheet material with a degree of stiffness and yet enable a self-sealing adhesive surface to be readily exposed and easily uncovered so that a seal can be formed.

Another object of the invention is to find a better, more effective way of surrounding or framing the photograph as well as hiding adhesive that is used to bond the sheets together.

Another object of the invention is to find a way of designing the unit so that the method of use is generally obvious to the user while at the same time minimizing the amount of pressure-sensitive adhesive that is required in its construction.

Another object is to provide a postcard for holding an inserted photograph which will pass through the mail without difficulty and yet will attach itself to a vertical surface.

These and other more detailed object and specific objects of the present invention will be better understood by reference to the following figures and detailed description which illustrate by way of example but a few of the various forms of the invention within the scope of the appended claims.

THE FIGURES

SUMMARY OF THE INVENTION

The invention provides a personalized picture postcard for holding inserted photographs that includes a backing sheet of a rectangular shape that has an exposed lower surface provided with printed indicia indicating the location of a mailing address and a position for writing a message to the recipient, a rectangular transparent window sheet adhesively bonded to an upper surface of the backing sheet along three aligned side edges to define an envelope therebetween that is open on one end. The backing sheet has a strip of pressure-sensitive adhesive extending along the remaining edge i.e., the free edge thereof. A removable cover strip or liner is releasably secured over the pressure-sensitive adhesive strip to define an open end into which a photo can be inserted by the user. A rectangular border is bonded to the postcard for framing the inserted photo. The border is aligned with the side and end edges of the postcard over the adhesive so as to obscure the adhesive and thus provide an attractive appearance.

DETAILED DESCRIPTION OF THE INVENTION

Figure 1:
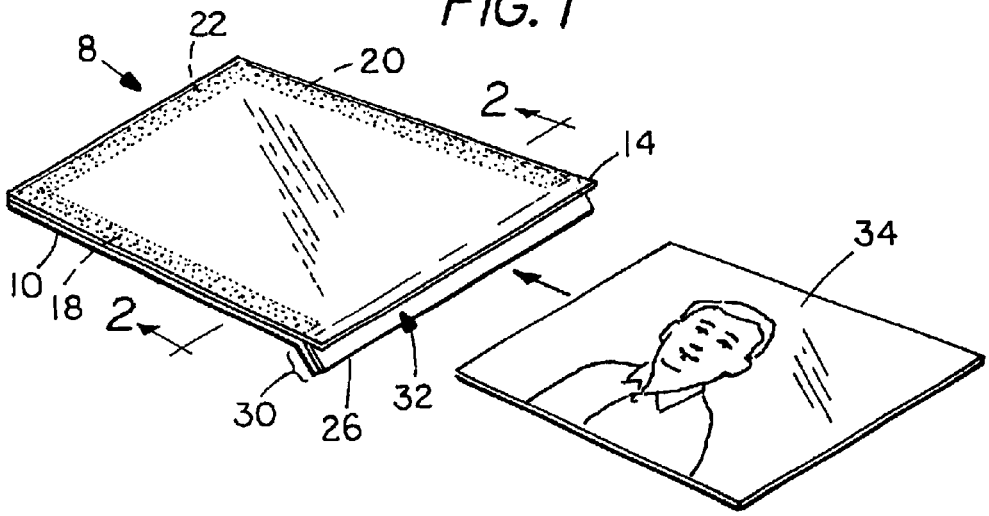
FIG. 1 is a perspective view of the invention shown just before a photograph is inserted into one end thereof.
Figure 2:
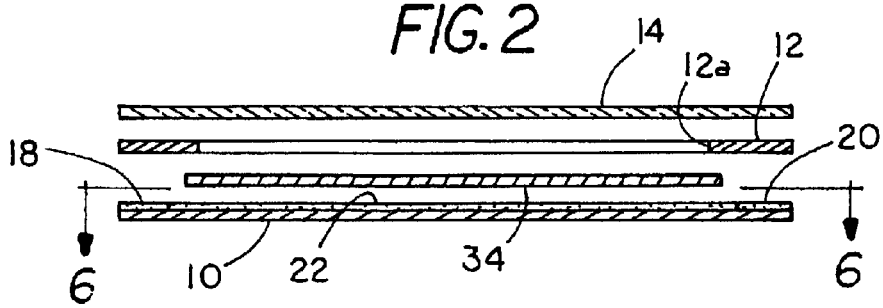
FIG. 2 is a transverse exploded cross sectional view taken on line 2—2 of FIG. 1 on a larger scale.
Figure 7:
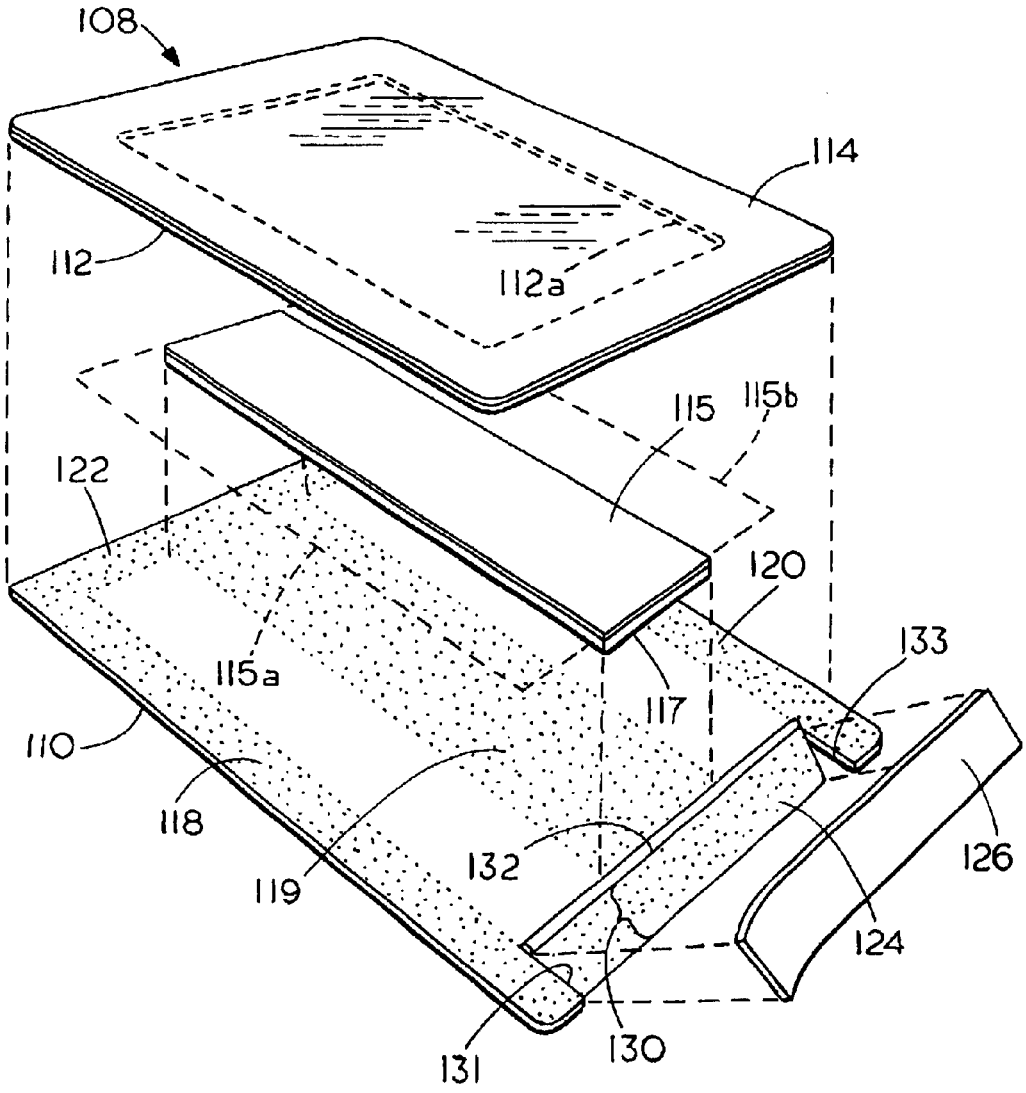
FIG. 7 is an exploded view of another embodiment of the invention.
Figure 8:
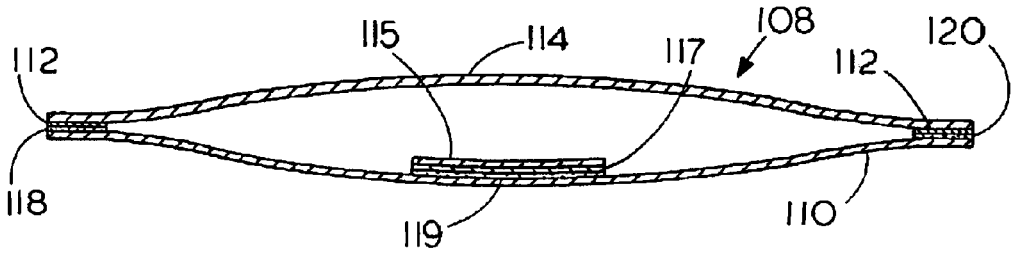
FIG. 8 is a vertical cross-sectional view taken on line 8—8 of FIG. 9.

Referring now to the drawings and especially to FIGS. 1, 2 and 7 it will be seen that the postcard 8 is a composite or laminate formed from three major components namely a backing sheet 10 a border 12 for framing the picture and a transparent window sheet 14 that can comprise a sheet of plastic such as a sheet of 10 mil. transparent polyvinyl chloride plastic which is self-supporting and has a certain degree of stiffness. By "self-supporting" we mean that it will stand up straight when held at one end. The backing 10 preferably comprises of a sheet of heavy paper or light paperboard e.g., 30 lb. white sulfite paper. The sheets 10, 14 and the border 12 can be about six and a half inches long by four and five eighths inches wide for accepting a four inch by six inch photograph. Other sizes can be provided to accommodate photographs of different sizes. The border 12 can be of any color or design for framing the picture and includes four segments that are aligned with the edges of the postcard 8. The border of FIGS. 2 and 7 is printed and comprises layers of printing ink applied to the lower surface of the window sheet 14. It can be printed on either the upper or lower surface as desired but is preferably printed on the lower surface because it will then be protected and cannot be damaged or wear off. If desired, the border 12 can also comprise a separate layer of sheet material such as a thin layer of colored paper or plastic having an open center 12*a*. The border is typically about one half inch in width from its outer edge to the open center 12*a*.

The sheets 10 and 14 are bonded together by means of adhesive strips 18 and 20 running along opposite side edges and an end strip 22 of adhesive which extends along the end edge furthest from the observer in FIGS. 1 and 7. For clarity of illustration, the border 12 has been shown only in FIGS. 2 and 7.

A pressure-sensitive adhesive strip 24 extends along an edge of the backing 10 opposite the strip 22. However, the pressure-sensitive adhesive strip 24 is covered by means of a removable liner or cover strip 26 which is shown partially pealed back in FIG. 4 at 26*a* so as to expose the self-sealing pressure-sensitive adhesive strip 24 when a bond is to be formed. Adjacent to the strip 24 and spaced somewhat inwardly a row of perforations 28 parallel to strip 24 that define a fold line for a flap 30 which hangs down somewhat or can be easily pushed down to an inclined position as shown in the Figures. The inclined flap 30 exposes an opening or mouth 32 between the sheets 10 and 14 (FIG. 1) into which a photograph 34 that is supplied by the user, and itself forms no part of the invention, can be easily inserted into place between the sheets 10 and 14. Once inserted, the photograph 34 will be nicely framed by the border 12 which also hides the adhesive strips 18–24.

Figure 4:
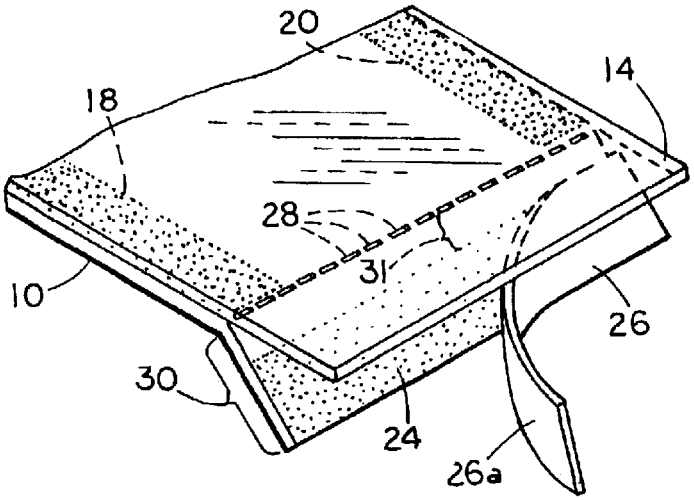
FIG. 4 is a view similar to FIG. 3 showing the cover strip partially removed.
Figure 5:
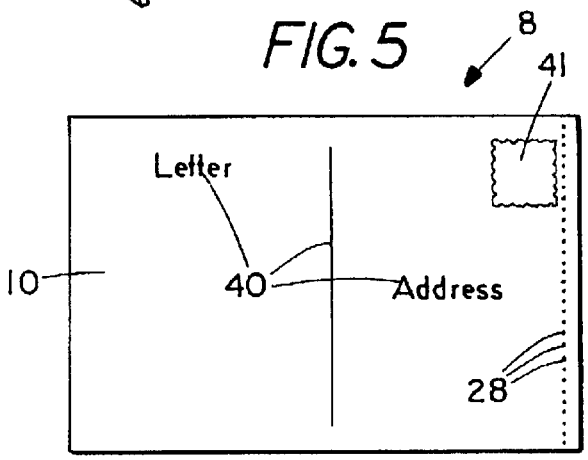
FIG. 5 is a bottom plan view of the invention.
Figure 6:
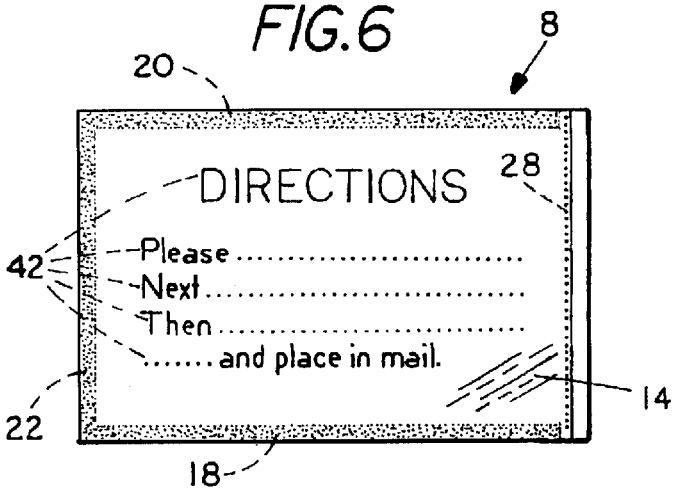
FIG. 6 is a top plan view of the invention.

While a fold line can be formed by embossing or scoring, it is preferred to form the fold line by means of the perforations or punched openings 28 to enable the flap 30 to bend more easily to the open position shown in FIG. 1 so that the mouth 32 is easily exposed to receive the photograph 34. Once the photograph 34 is inserted completely, the removable liner 26 is pulled off as shown in FIG. 4 and discarded. The self-sealing pressure-sensitive adhesive strip 24 is then pressed against the opposed confronting under surface of the window sheet 14 thereby sealing the photograph 34 on all sides within the postcard 8.

As already noted, the lower surface of the backing sheet 10 is provided with printed indicia 40 for indicating a place for writing an address and message to the recipient of the postcard. The printed indicia 40 can comprise the words, "letter" and "address" with a vertical line indicating a separation between the two. The indicia 40 can also provide a location 41 for a postage stamp if desired.

The upper surface of the backing sheet 10 is printed with a second set of indicia 42 comprising directions for use. These directions can easily be seen since they are clearly visible through the plastic window sheet 14 when the postcard is about to be used but will be covered by the inserted photograph when no longer needed. The indicia 42 consist of instructions for lifting and bending back the flap 30 and inserting a photograph. The user is also instructed to remove the peel-off strip or liner 26 as shown in FIG. 4 and press the adhesive 24 against the lower surface of the window sheet 14 to seal the photograph 34 on all sides within the postcard 8.

Figure 3:
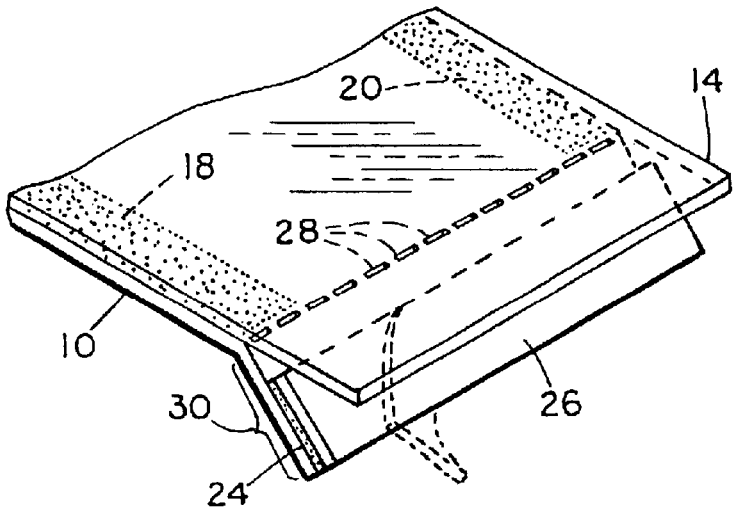
FIG. 3 is a partial perspective view of the invention showing an adhesive liner or cover strip before it is removed.
Figure 1A:
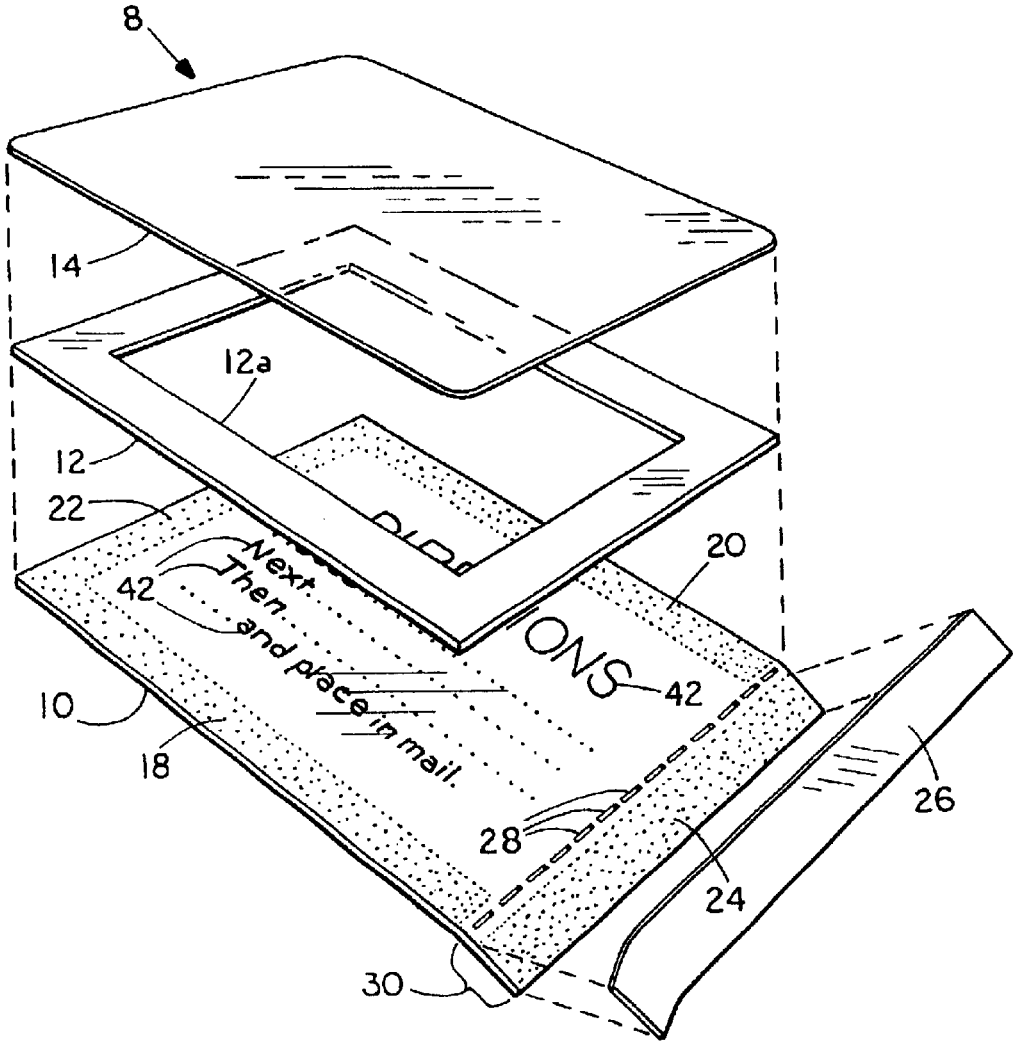

It can be seen that a gap 31 (FIGS. 3 and 4) devoid of adhesive is provided between the adhesive strip 24 and the fold line defined by the perforations 28 so that even if a person inserts a photograph after the liner 26 has been removed it, will not jam by becoming stuck to the adhesive strip 24.

Refer now to the embodiment of FIGS. 7–10. In this embodiment, the postcard 108 is a trilaminate structure formed from three major components, namely, a backing sheet 110, a transparent window sheet 114 that can comprise a sheet of plastic such as a sheet of 10 mil. transparent polyvinyl chloride plastic which is self-supporting and has a certain degree of stiffness and a flexible magnetic sheet or strip 117 that is sandwiched between them. The term "self-supporting" when applied to the window sheet means that it will stand up straight when held at one end. The backing 110 preferably comprises of a sheet of heavy paper or light paperboard e.g., 30 lb. white sulfite paper. The sheets 110, 114 and a border 112 can be about six and a half inches long by four and five eighths inches wide for accepting a four inch by six inch photograph. The magnetic strip 117 can be, for example, a 1.5 inch wide strip of flexible magnetic sheeting that is 5.5 inches long. Sheets of other sizes can be provided to accommodate photographs of different sizes.

The border 112 can be of any color or design for framing the picture and includes four segments that are aligned with the edges of the postcard 8. In this case, the border 112 is printed on the window sheet and comprises one or more layers of printing ink applied to the lower surface of the window sheet 114. It can be printed on either the upper or lower surface as desired but is preferably printed on the lower surface because it will then be protected and cannot be damaged or wear off. If desired, the border 112 can in the alternate comprise a separate layer of sheet material such as a thin layer of colored paper or plastic having an open center 112*a*. The border is typically about one half inch in width from its outer edge to the open center 112*a*.

The sheets 110 and 114 are bonded together by means of adhesive strips 118 and 120 running along opposite side edges and an end strip 122 of adhesive which extends along the end edge furthest from the observer in FIG. 7.

Figure 9:
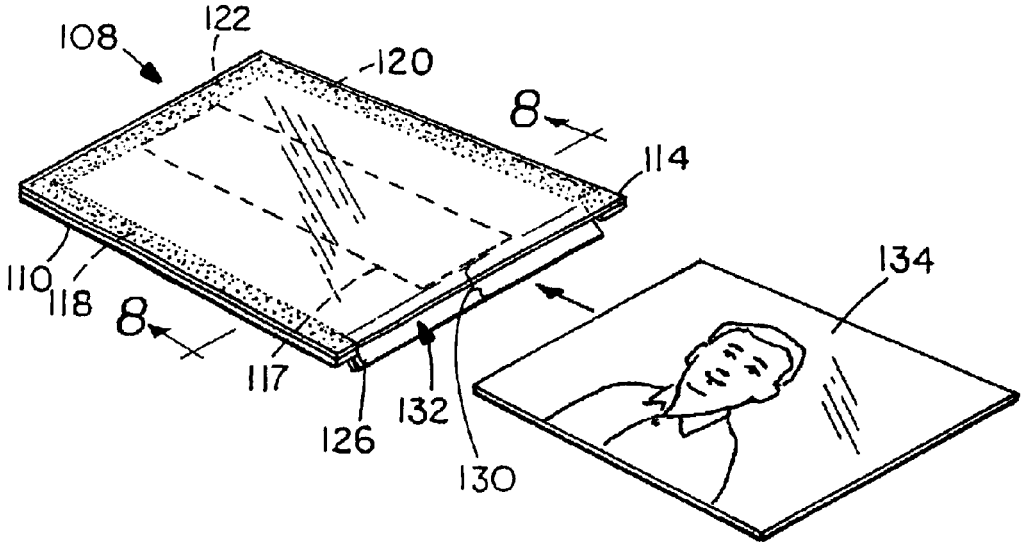
FIG. 9 is a perspective view of the embodiment of FIG. 7 following assembly just prior to inserting a photograph.

A pressure-sensitive adhesive strip 124 extends along an edge of the backing 110 opposite the strip 122. However, the pressure-sensitive adhesive strip 124 is covered by a removable liner or cover strip 126 which is shown fully removed in FIG. 7 so as to expose the self-sealing pressure-sensitive adhesive strip 124 when a bond is to be formed. Adjacent to the strip 124 and parallel to the edge of the backing 110 is an embossed fold line 132 for defining a flap 130 which hangs down somewhat or can be easily pushed down between spaced cuts 131 and 133 to an inclined position as shown in FIGS. 7 and 9. The inclined flap 130 exposes an opening or mouth 132 (FIG. 9) between the sheets 110 and 114 (FIG. 9) into which a photograph 134 that is supplied by the user, and itself forms no part of the invention, can be easily inserted into place between the sheets 110 and 114. Once inserted, the photograph 134 will be nicely framed by the border 112 which also hides the adhesive strips 118–124. The flexible magnetic strip 117 is covered by an attached piece of paper or white paint 115 and is attached to the backing 110 by an adhesive strip 119 e.g. pressure-sensitive adhesive applied to its lower surface or optionally by making the paper strip 115 wider with side portions 115*a* and (FIG. 7) which can be adhesively bonded to sheet 110.

The fold line 132 can be formed by embossing or scoring or by means of the perforations or by spaced apart, laterally extending punched openings (not shown) to enable the flap 130 to bend more easily to the open position shown in FIGS.

7 and 9 so that the mouth 132 is easily exposed to receive the photograph 134. It should be noted that while the flap 124 is bent at an inclined angle, the window sheet 114 remains flat thereby providing a smooth surface which acts to facilitate the insertion of the leading edge of the photo into the mouth 132 of the postcard 108. Once the photograph 134 is inserted completely, the removable liner 126 is pulled off as shown in FIG. 7 and discarded. The self-sealing pressure-sensitive adhesive strip 124 is then pressed against the opposed confronting under surface of the window sheet 114 thereby sealing the photograph 134 on all sides within the postcard 108.

The backing sheet 110 is provided with printed indicia on its lower surface for indicating a place for writing an address and message to the recipient of the postcard. The printed indicia can comprise the words, "letter" and "address" with a vertical line indicating a separation between the two. The indicia can also provide a location for a postage stamp if desired.

Printed on the backing 110 to the right of paper strip 115 is the phrase, "Turn your picture into a postcard." On paper strip 115 is printed, "And it's a magnet, too." To the left of strip 115 is printed a diagram depicting the insertion of a photo and of sealing the flap 124. These directions can easily be seen since they are clearly visible through the plastic window sheet 114 when the postcard is about to be used but will be covered by the inserted photograph when no longer needed. The printed indicia thus include instructions for lifting and bending back the flap 130 and inserting a photograph. The user is also instructed to remove the peel-off strip or liner 126 as shown in FIG. 7 and press the adhesive 124 against the lower surface of the window sheet 114 to seal the photograph 134 on all sides within the postcard 108 which will pass without any problem through the mail and then can be magnetically supported by the recipient on a vertical surface such as the door of a cabinet or refrigerator.

While the magnetic strip 117 is positioned centrally to extend lengthwise of the postcard 108, it can be placed anywhere within the postcard without interfering with the proper operation of Post Office equipment so long as it is not on the outside of the postcard. With the strip 117 located centrally, as shown, the postcard can be placed on a refrigerator in an up-and-down orientation or crosswise orientation and will be held securely in place.

Figure 10:
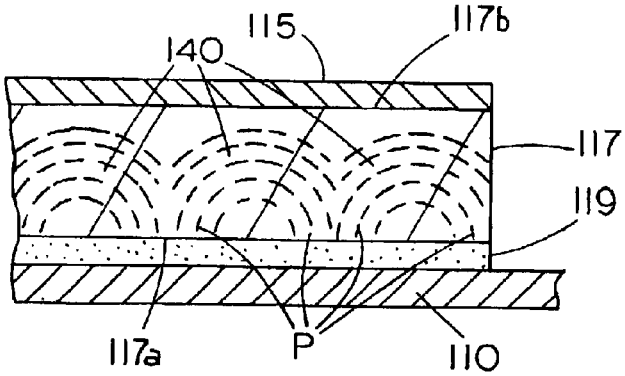
FIG. 10 is a partial cross-sectional view of the magnetic strip 117 of FIG. 8 but on a greatly enlarged scale.

Refer now to FIG. 10. As shown in the figure, this magnetic strip 117 has a plurality of parallel longitudinally extending rows or zones 140 of magnetic material therein which terminate along a plurality of longitudinally extending laterally distributed poles P that together define a magnetic lower surface 117*a* on the underside of the magnetic strip 117. The rows 140 can extend either along the length or across the strip 117. Typically there are 12 poles P per inch across the width of strip 117. The upper surface 117*b* is nonmagnetic. Good performance results were obtained by bonding the magnetic surface 117*a* of strip 117 by the adhesive layer 119 to the paper backing 110. When place on a refrigerator door or other vertical metallic object, flux lines from the magnetic surface 117*a* penetrate the paper backing 110 and adhesive layer 119 so as to securely retain the postcard 108 in place thereon for displaying the enclosed photo 134 through the window sheet 114.

It was found that the invention is durable, rugged in construction, can be manufactured at relatively low cost partly because adhesive is required only at the edges and beneath the magnetic strip. Moreover it is highly effective in protecting photographs during transport in the mail. In addition the mouth of the postcard 108 where the photo 134 is to be inserted opens easily and conveniently for enabling the user to quickly insert the photograph with a minimum of manipulation. The invention is also easy to use since it requires only that the photograph be inserted, the liner strip be removed and the seal formed between the adhesive strip 124 and the opposed confronting surface of the window sheet 114. The postcard with the magnetic sheet 117 is able to pass through the mail without fouling the Post Office equipment and, after mailing, it can be attached to a refrigerator door, a cabinet, or other metal object by the magnetic strip 117.

It will be noted that the finished postcard 108 includes a transparent rectangular window sheet 114 which is self-supporting i.e. naturally remains flat when handled and is of uniform stiffness throughout so as to remain flat during use. The stiff backing sheet 110 is bonded along three edges to aligned edges of the transparent window sheet 114 as already described. The backing sheet 110 most preferably comprises paperboard or cardboard. The fold line 132 in the backing sheet is formed by embossing or scoring and as shown in FIG. 7 extends parallel to the free edge of the backing sheet at the right in FIG. 7. Thus the fold line 132 defines a mouth at the right end of the postcard 108 to facilitate inserting the photograph 34. During shipment and storage the flap 124 remains flat against the window sheet 114 and in the plane of the backing 110 to permit efficient stacking of the postcards 108. Only just before the photo is to be inserted the flap 124 is folded downwardly as seen in FIG. 7 away from the window sheet. It will be noted that the ends of the flap 124 and the removable cover sheet 126 terminate in spaced relationship inwardly from the side edges of the postcard 108 at the spaced cuts 131 and 133. When the flap portion 124 of the backing is folded away from the window sheet along the fold line 132 to open the mouth, the flat window sheet acts as a level cam surface to assure sliding movement of the photograph thereagainst thereby facilitating the insertion of the photograph into the postcard. The adhesive strip 130 that is on the flap 124 is then pressed against the adjacent portion of the window sheet 114 following removal of the cover strip 126 to seal the mouth closed. It will be noted that the edge of the photograph during insertion will slide on the flat window sheet which acts as a slippery plane so that the photograph cannot catch on anything such as the magnetic sheet 115 which is on the backing sheet 110.

Many variations of the present invention within the scope of the appended claims will be apparent to those skilled in the art once the principles described herein are understood.

What is claimed is:

1. A personalized picture postcard for holding inserted photographs supplied by the user comprising, a trilaminate structure including a backing sheet of rectangular shape having an upper surface and an exposed lower surface, printed indicia on the lower surface of the backing sheet for designating the location of an address and a message to the recipient of the postcard, a transparent rectangular window sheet adhesively bonded to corresponding aligned edges of an upper surface of the backing sheet on three edges thereof to define an envelope that is open at one end thereof for receiving a photograph supplied by the user and, a strip of flexible magnetic sheeting connected to the backing sheet whereby the postcard containing the photograph can be attached to a vertical metallic object by the magnetic sheeting, the magnetic sheeting has a magnetic lower surface and a nonmagnetic upper surface and a layer of adhesive bonds the magnetic sheeting to a surface of the backing sheet.

2. The postcard of claim 1, wherein a rectangular border is applied to the postcard for framing the photograph that is supplied by the user, said border including segments that are aligned with edges of the postcard.

3. The postcard of claim 2 wherein the border is printed thereon.

4. The postcard of claim 3 wherein the border is printed upon a lower surface of the transparent window sheet.

5. The postcard of claim 1 wherein the backing sheet has a pair of opposed end edges and a pair of opposed side edges, an adhesive is applied to the opposed side edges and one of the end edges and a strip of pressure-sensitive adhesive is applied along a remaining end edge and, a fold line is positioned on the backing sheet to extend adjacent said pressure-sensitive adhesive strip and parallel thereto for defining a flap that can be folded away from the transparent window sheet to provide a mouth adapted for receiving said photograph supplied by the user between the window sheet and the magnetic sheeting and the window sheet remains flat for providing a smooth surface to facilitate insertion of the photograph into the open end of the postcard.

6. The postcard of claim 1 wherein a second set of indicia is printed upon an upper surface of the backing sheet so as to be visible through the transparent window sheet, said second set of indicia provides directions for the use of the invention including instructions for the insertion of photograph therewithin and for sealing an adhesive strip to an opposed surface to enclose the photograph on all sides within the postcard.

7. The postcard of claim 1 wherein the magnetic sheeting is an elongated strip of sheeting that extends lengthwise of the postcard.

8. The postcard of claim 1 wherein the magnetic sheeting has a plurality of parallel rows of magnetic material therein terminate in poles located at the magnetic lower surface thereof such that magnetic flux lines pass from the poles through both the layer of adhesive and the backing sheet for securing the postcard to a metallic object.

9. The postcard of claim 1 wherein the magnetic sheeting has a strip of flexible sheet material laminated to the upper surface thereof.

10. The postcard of claim 9 wherein printed indicia is applied to an upper free surface of the strip of flexible sheet material that is laminated onto the magnetic sheeting.

11. The postcard of claim 9 wherein printed indicia is applied to an upper free surface of the strip of flexible sheet material that is laminated onto the magnetic sheeting and a plurality of parallel rows of magnetic material therein terminate in poles located at the magnetic lower surface thereof such that magnetic flux lines pass from the poles through both the layer of adhesive and the backing sheet for securing the postcard to a metallic object.

12. The postcard of claim 1 where the magnetic sheeting is enclosed between said sheets and the magnetic lower surface thereof is bonded to the backing sheet.

* * * * *